US005418098A

United States Patent [19]

Mayama et al.

[11] Patent Number: 5,418,098

[45] Date of Patent: May 23, 1995

[54] ELECTROPHOTOGRAPHIC PHOTOSENSITIVE MEMBER, AND ELECTROPHOTOGRAPHIC APPARATUS, DEVICE UNIT AND FACSIMILE MACHINE HAVING THE PHOTOSENSITIVE MEMBER

[75] Inventors: Shinya Mayama, Yamato; Teigo Sakakibara, Yokohama; Noriko Ohtani, Yokohama; Katsumi Aoki, Yokohama; Noriyoshi Ogawa, Toyonaka; Satoshi Kanayama, Takarazuka, all of Japan

[73] Assignee: Canon Kabushiki Kaisha, Tokyo, Japan

[21] Appl. No.: 904,280

[22] Filed: Jun. 25, 1992

[30] Foreign Application Priority Data

Jun. 28, 1991 [JP] Japan ..... 3-183358

[51] Int. Cl.[6] ..... G03G 15/02

[52] U.S. Cl. ..... 430/58; 430/57; 430/96

[58] Field of Search ..... 430/96, 58, 57

[56] References Cited

U.S. PATENT DOCUMENTS

| | | | |
|---|---|---|---|
| 2,999,750 | 9/1961 | Miller et al. | 96/1 |
| 4,637,971 | 1/1987 | Takei et al. | 430/59 |
| 4,956,256 | 9/1990 | Ohtsuka et al. | 430/96 |
| 4,985,326 | 1/1991 | Sakamoto | 430/96 |
| 5,213,924 | 5/1993 | Sakamoto | 430/58 |

FOREIGN PATENT DOCUMENTS

| | | |
|---|---|---|
| 62-187353 | 8/1987 | Japan . |
| 2240655 | 9/1990 | Japan . |
| 403273255 | 12/1991 | Japan . |

OTHER PUBLICATIONS

English Translation of JP 3273255.

*Primary Examiner*—S. Rosasco

*Attorney, Agent, or Firm*—Fitzpatrick, Cella, Harper & Scinto

[57] ABSTRACT

There is disclosed an electrophotographic photosensitive member comprising a conductive support and a photosensitive layer provided thereon, wherein the photosensitive layer contains a random copolymer having a structural unit represented by the following Formula (I):

(I)

and a structural unit represented by the following Formula (II):

(II)

21 Claims, 2 Drawing Sheets

ELECTROPHOTOGRAPHIC PHOTOSENSITIVE MEMBER, AND ELECTROPHOTOGRAPHIC APPARATUS, DEVICE UNIT AND FACSIMILE MACHINE HAVING THE PHOTOSENSITIVE MEMBER

BACKGROUND OF THE INVENTION

1. Field of the Invention

The present invention relates to an electrophotographic photosensitive member. More particularly it relates to an electrophotographic photosensitive member having a photosensitive layer containing a resin with a specific structure. The present invention is also concerned with an electrophotographic apparatus, a device unit and a facsimile machine that have such a photosensitive member.

2. Related Background Art

Electrophotographic photosensitive members are, of course, required to be endowed with given sensitivity, potential characteristics and optical properties in accordance with electrophotographic processes applied. In particular, in the case of electrophotographic photosensitive members repeatedly used, they are required to have a durability to the electrical and mechanical external forces that act during electrostatic charging, developing, transfer and cleaning.

Specifically stated, they are required to have a durability against a decrease in sensitivity or dark portion potential caused by $O_3$ or $NO_x$ generated during corona charging, an increase in residual potential, and wear and scratches caused on their surfaces as a result of sliding friction.

In the case of electrophotographic photosensitive members making use of an organic photoconductive material, their surface layers usually contain resins, and hence the properties of resins are one factor having a great influence on the performance of photosensitive members.

As resins hitherto used in electrophotographic photosensitive members, a bisphenol-A type polycarbonate resin (hereinafter "polycarbonate-A") and a modified polycarbonate resin as disclosed in U.S. Pat. No. 2,999,750 or Japanese Patent Application Laid-open No. 62-187353 have been proposed. These resins, however, have the problems as shown below.

(1) The resins have such poor solubility that they exhibit good solubility only in a few kinds of halogenated aliphatic hydrocarbons, such as dichloromethane and 1,2-dichloroethane. These halogenated aliphatic hydrocarbons have a low boiling point. Hence, photosensitive members manufactured by the use of a coating solution prepared using any of these solvents tend to have whitened coating surfaces. In addition, use of such solvents requires troublesome process management such that the solid's content in coating solutions must be kept constant.

(2) With regard to solvents other than the halogenated aliphatic hydrocarbons, the resins are partly soluble in tetrahydrofuran, dioxane, cyclohexane, or a mixed solvent of these. The solutions obtained, however, have poor stability with time such that they may gel in a few days.

Use of bisphenol-Z type polycarbonate resins (hereinafter "polycarbonate-Z") has settled these problems. However, in recent years, as image quality, durability and productivity are increasingly made higher in the field of electrophotography, resins are being studied which can satisfy the required properties at a much higher level.

SUMMARY OF THE INVENTION

The objects of the present invention are to solve the problems as discussed above, involving conventional polycarbonate resins, and to provide an electrophotographic photosensitive member having superior mechanical properties such as lubricity and wear resistance, capable of stably giving images with a high image quality even after repeated use, and also achieving cost reduction and easy manufacture.

The present invention provides an electrophotographic photosensitive member comprising a conductive support and a photosensitive layer provided thereon, wherein said photosensitive layer contains a random copolymer having a structural unit represented by the following Formula (I):

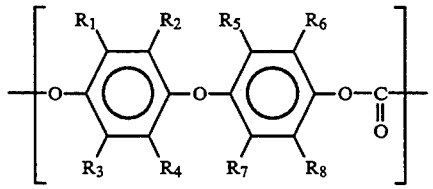

(I)

wherein $R_1$ to $R_8$ each represent a hydrogen atom, a halogen atom, a hydroxyl group or an alkyl group having 1 to 4 carbon atoms; and a structural unit represented by the following Formula (II):

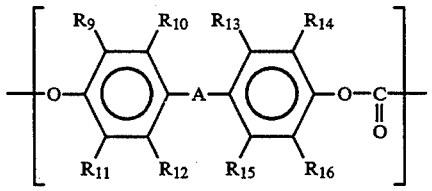

(II)

wherein A represents a straight-chain, branched or cyclic alkylidene group having 1 to 10 carbon atoms, an aryl-substituted alkylidene group or an arylene group; and $R_9$ to $R_{16}$ each represent a hydrogen atom, a halogen atom, a hydroxyl group or an alkyl group having 1 to 4 carbon atoms.

The present invention also provides an electrophotographic apparatus, a device unit and a facsimile machine each having the above electrophotographic photosensitive member.

DESCRIPTION OF THE PREFERRED EMBODIMENTS

Figure 1:
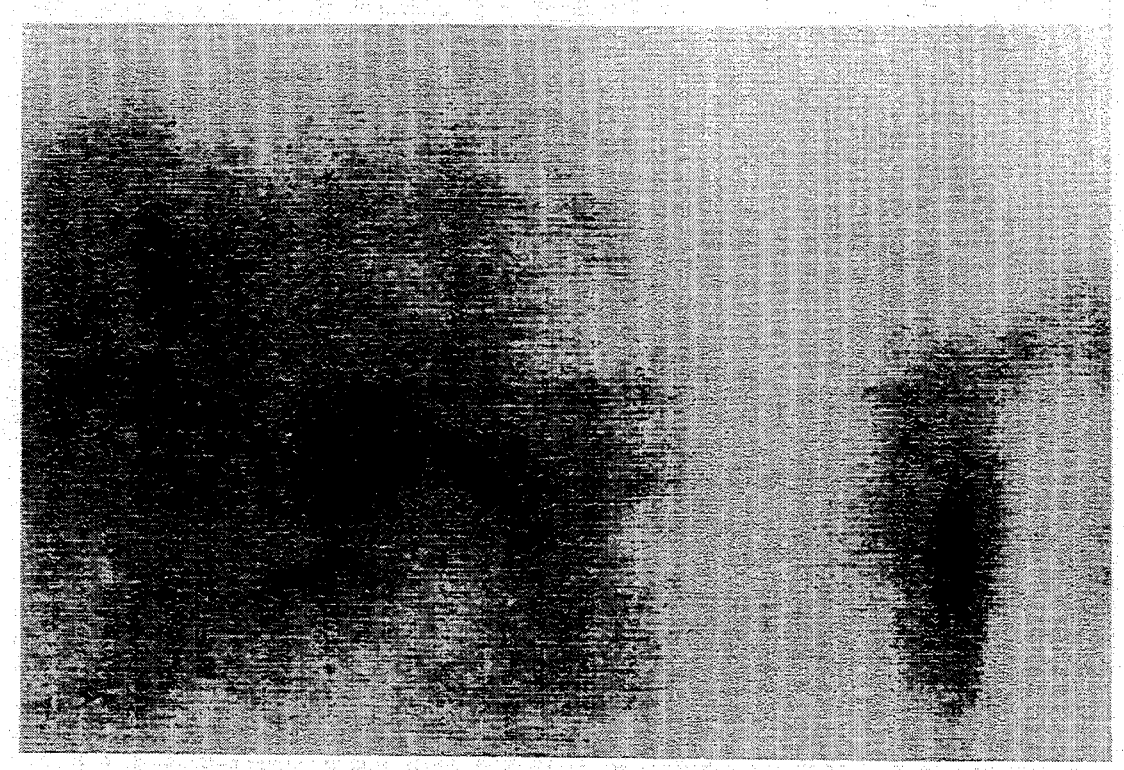
FIG. 1 is a TEM photograph of the random copolymer used in the present invention.

The electrophotographic photosensitive member comprises a photosensitive layer containing a random copolymer having structural units, represented by the following Formulas (I) and (II) respectively:

(I)

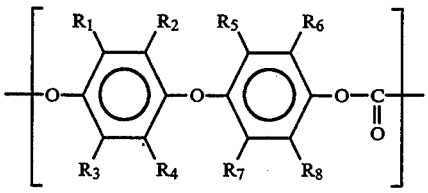

wherein $R_1$ to $R_8$ each represent a hydrogen atom, a halogen atom, a hydroxyl group or an alkyl group having 1 to 4 carbon atoms; and (II)

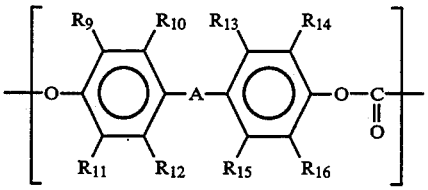

wherein A represents a straight-chain, branched or cyclic alkylidene group having 1 to 10 carbon atoms, an aryl-substituted alkylidene group or an arylene group; and $R_9$ to $R_{16}$ each represent a hydrogen atom, a halogen atom, a hydroxyl group or an alkyl group having 1 to 4 carbon atoms.

The random copolymer used in the present invention can be obtained by subjecting a bisphenol having a structure represented by the following Formula (III):

(III)

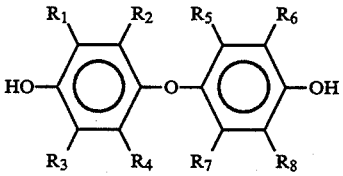

wherein $R_1$ to $R_8$ are as defined above; and a bisphenol having a structure represented by the following Formula (IV):

(IV)

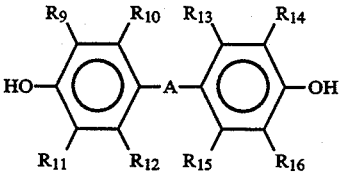

wherein A and $R_9$ to $R_{16}$ are as defined above; to interfacial polymerization in the presence of phosgene, carbonic acid ester or chloroformic acid ester.

In the present invention, the component unit represented by Formula (I) is introduced for the purpose of imparting suitable flexibility to the polycarbonate resin, and is presumed not to prohibit free rotation of phenol groups and, at the same time, impart flexibility inherent in ether bonds to enable improvement of mechanical properties and durability.

Preferred examples of the bisphenol represented by Formula (III) are shown below. Examples are by no means limited to these.

(III-1)

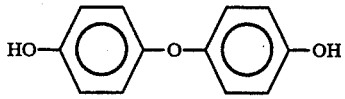

(III-2)

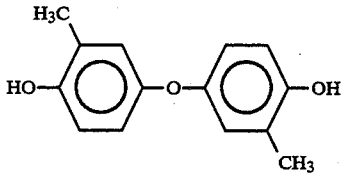

(III-3)

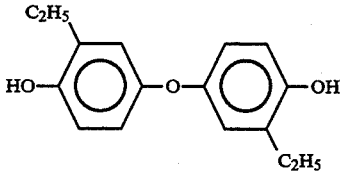

(III-4)

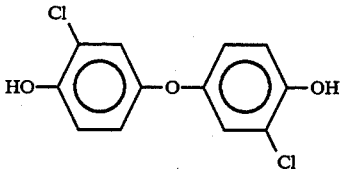

(III-5)

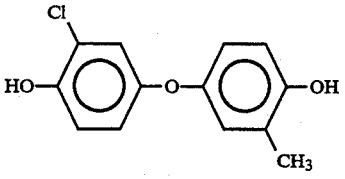

(III-6)

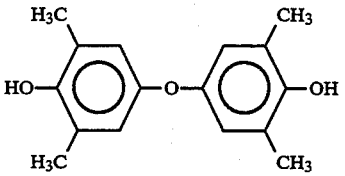

Bisphenol represented by (III-1) is particularly preferred among these compounds.

In the present invention, the structural unit represented by Formula (II) is presumed to impart a suitable mechanical strength to the polycarbonate resin.

Preferred examples of the bisphenol represented by Formula (IV) are shown below. Examples are by no means limited to these.

(IV-1)

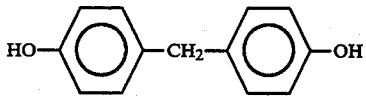

(IV-2)

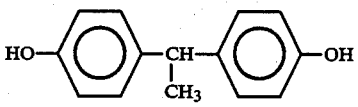

-continued
(IV-3)
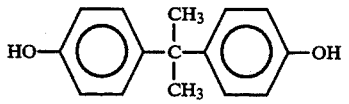
(IV-4)
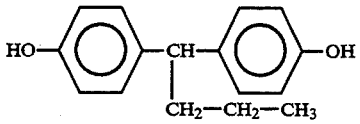
(IV-5)
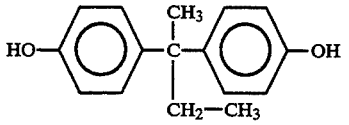
(IV-6)
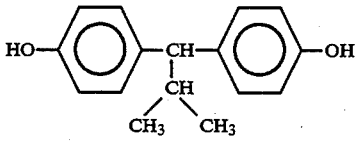
(IV-7)
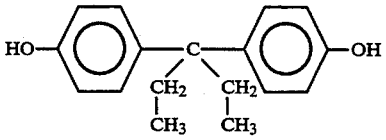
(IV-8)
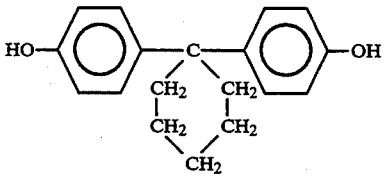
(IV-9)
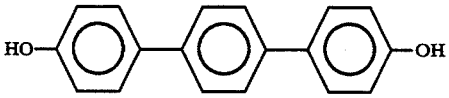
(IV-10)
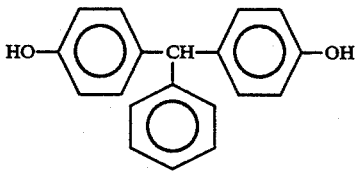
(IV-11)
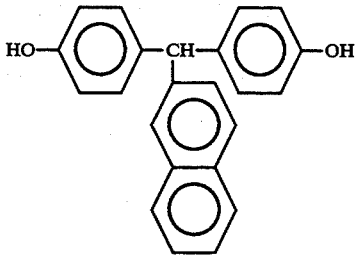
-continued
(IV-12)
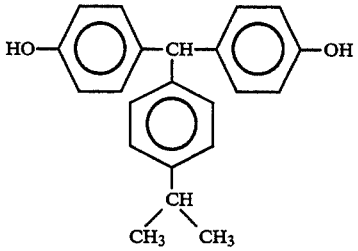
(IV-13)
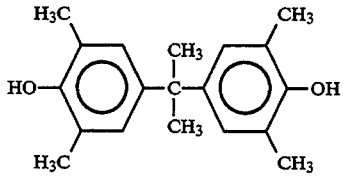
(IV-14)
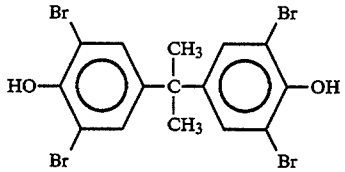
(IV-15)
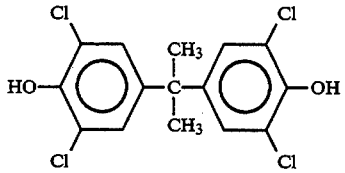
(IV-16)
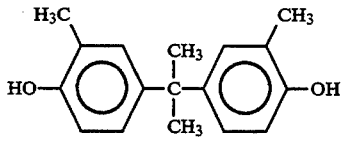
(IV-17)
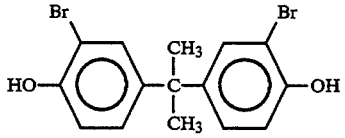
(IV-18)
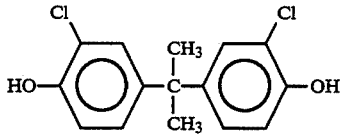
(IV-19)
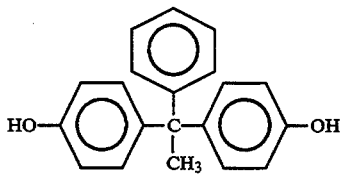

-continued (IV-20)

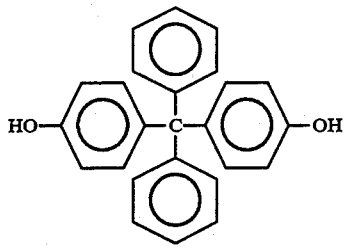

Among these compounds, bisphenols (IV-3), (IV-4), (IV-16), (IV-19) and (IV-20) are particularly preferred, and bisphenol (IV-3) is more preferred.

However, the generation of gels that may cause faulty images in electrophotography, which is concerned with storage stability of solutions, can not be well prevented if only a copolymer is formed, and can be well prevented when the copolymer is formed particularly as a random copolymer so that the crystallinity of polymer segments themselves can be lowered. That is, in the present invention, the copolymer formed as a copolymer in which monomers are randomly copolymerized can greatly lower the speed of gelation and enables prevention of faulty images such as black spots. Moreover, introduction of non-bulky groops into the structure of structural units is particularly preferred since it is presumed that the mutual overlap of polymers is thereby improved to give a highly sensitive electrophotographic photosensitive member. If, on the other hand, the copolymer can not retain its randomness (uniformity), gelation thereof may occur from its part comprised of block segments to tend to cause faulty images such as black spots.

Figure 2:
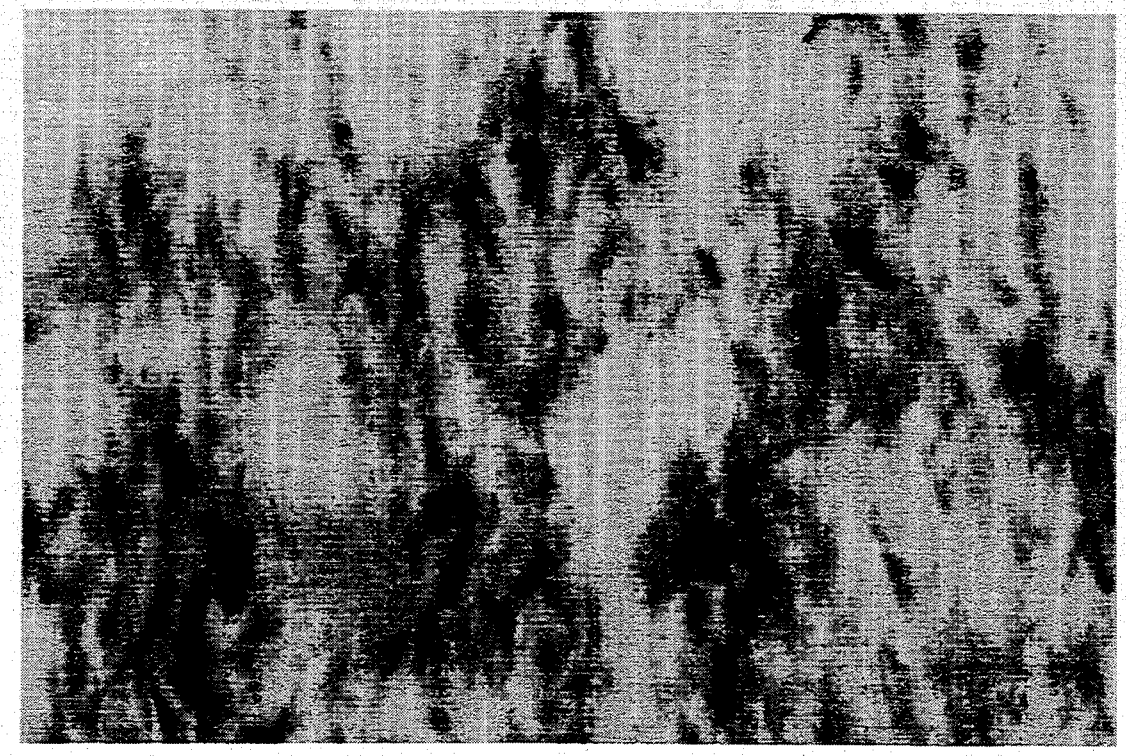
FIG. 2 is a TEM photograph of a copolymer having a non-uniform structure.

Such randomness (uniformity) of the copolymer can be evaluated by observation, using a transmission electron microscope (TEM), of the structure of a coating formed by applying the copolymer dissolved in a suitable solvent, to a suitable substrate such as an aluminum substrate or a glass substrate. More specifically, if the copolymer is the random compolymar, even a slight non-uniformity can not be recognized on observation with a TEM (see FIG. 1). If, on the other hand, the copolymer even slightly has block segments, non-uniform structure is seen on the observation (see FIG. 2). Such microscopic non-uniform structure is presumed to cause the gel generation which results in image defects.

The proportion of the aforementioned structural units contained in the copolymer must be selected taking account of anti-scratch properties and hardness required according to electrophotographic processes. Taking account of the capability of stable formation of the random copolymer, and the mechanical properties, electrical properties and environmental stability of these properties, the structural unit represented by Formula (I) and structural unit represented by Formula (II) may preferably be in a proportion of (I):(II)=5:95 to 95:5, particularly preferably (I):(II)=20:80 to 70:30, and more preferably (I):(II)=35:65 to 65:35, in the ratio of copolymerization (molar ratio).

The reason therefor can be considered to concern various factors. As stated above, the randomness of the copolymer and polymerization composition are important factors for the mechanical properties and electrophotographic images, and hence it is presumed that the copolymer can not retain the randomness of its segments if any one of the components is in large excess.

A synthesis example of the random copolymer used in the present invention is shown below.

Synthesis Example

In 42 lit. of water, 3.7 kg of sodium hydroxide was dissolved. While the solution was maintained at 20° C., 3.65 kg of bisphenol-A (IV-3) and 3.23 kg of 4,4'-dihydroxydiphenyl ether (III-1) and 8 g of hydrosulfite were dissolved therein.

To the resulting solution, 28 lit. of methylene chloride was added, and 48 g of p-t-butylphenol was further added with stirring, followed by blowing of 3.5 kg of phosgene over a period of 60 minutes. After the blowing of phosgene, the reaction mixture was vigorously stirred to effect emulsification, taking good care not to cause crystallization. After the reaction mixture was well emulsified, 8 g of triethylamine was added thereto, followed by stirring for about 1 hour to effect polymerization.

The polymerization mixture was separated into an aqueous phase and an organic phase, and the organic phase was neutralized with phosphoric acid, and thereafter repeatedly washed with water until the pH of the wash liquid became neutral, followed by addition of 35 lit. of isopropanol to precipitate the polymerization product. The precipitate obtained was filtered and thereafter dried to give a white powdery polycarbonate resin.

The random copolymer used in the present invention may preferably have a solubility of not less than 1 g, and particularly preferably not less than 5 g, in 100 cc of solvent. This is because, if its solubility is less than 1 g/100 cc, the solution tends to have a low viscosity when, for example, a charge transport layer coating solution is prepared, making it impossible to give a layer thickness suited for the charge transport layer.

As to the molecular weight of the copolymer, the copolymer may preferably have a viscosity average molecular weight (Mv) ranging from 10,000 to 150,000, and particularly preferably from 40,000 to 100,000, taking account of the durability, i.e., wear resistance and anti-scratch properties, and the viscosity required when the copolymer is produced, i.e., productivity.

In the present invention, the copolymer used in the present invention may have two or more kinds of copolymerization components having the structure represented by Formula (I). Similarly, it may have two or more kinds of copolymerization components having the structure represented by Formula (II).

In the present invention, the copolymer used in the present invention may be used in the form of a mixture of two or more kinds. The copolymer used in the present invention may also be used in a mixture thereof with a different type of resin. Such a different type of resin may include polyester resins, acrylic resins, polyethylene resins, polypropylene resins, polyvinyl carbazole resins, phenoxy resins, polycarbonate resins, polyvinyl butyral resins, polystyrene resins, polyvinyl acetate resins, polysulfone resins, polyacrylate resins, and polyvinylidene-acrylonitrile copolymer resins.

The photosensitive layer in the present invention may be a single layer type, in which a charge-generating material and a charge-transporting material are contained in the same layer, or a lamination type, in which the layer is functionally separated into a charge generation layer containing a charge-generating material and a charge transport layer containing a charge-transporting material. In the present invention, the lamination type is preferred, and the type in which the charge transport layer is formed on the charge generation layer is particularly preferred.

The charge generation layer can be formed by coating a solution prepared by dissolving a charge-generating material in a binder resin, followed by drying. Such a charge-generating material may include azo pigments such as Sudan Red and Dian Blue, quinone pigments such as pyrene quinone and anthanthrone, quinocyanine pigments, perylene pigments, indigo pigments such as indigo and thioindigo, azulanium salt pigments, and phthalocyanine pigments such as copper phthalocyanine. As the binder resin, at least the copolymer of the present invention is used when the charge generation layer is a surface layer. When it is not a surface layer, a different type of resin may be used, without use of the copolymer of the present invention. Such a different type of resin may be the same as those previously described.

The charge-generating material and the binder resin may preferably in a proportion of from 1:5 to 5:1, and particularly preferably from 1:2 to 3:1, in weight ratio. The charge generation layer may preferably have a layer thickness of not more than 5 μm, and particularly preferably from 0.05 to 2 μm.

The charge-transporting material contained in the charge transport layer may include polycyclic aromatic compounds such as biphenylene, anthracene, pyrene and phenanthrene, nitrogen-containing cyclic compounds such as indole, carbazole, oxazole and pyrazoline, hydrazone compounds, and styryl compounds.

In general, because of poor film forming properties, the charge-transporting material is dissolved in a suitable binder resin and then put into use. As the resin, the copolymer of the present invention is used when the charge transport layer is a surface layer. When it is not a surface layer, a different type of resin may be used, without use of the copolymer of the present invention. Such a different type of resin may be the same as those previously described.

The charge transport layer can be formed by coating a solution prepared by dissolving a charge-transporting material and a binder resin in a suitable solvent, followed by drying. The charge-transporting material and the binder resin may preferably be mixed in a proportion of from 3:1 to 1:3, and particularly preferably from 2:1 to 1:2 in weight ratio.

The charge transport layer may preferably have a layer thickness of from 5 to 40 μm, and particularly preferably from 10 to 30 μm.

In the case where the photosensitive layer is of the single layer type, it can be formed by coating a solution prepared by dispersing and dissolving the charge-generating material and charge-transporting material as described above into a binder resin, followed by drying.

As the binder resin, at least the copolymer of the present invention is used when the photosensitive layer is a surface layer. When it is not a surface layer, a different type of resin may be used, without use of the copolymer of the present invention. Such a different type of resin may be the same as those previously described.

The photosensitive layer may preferably have a layer thickness of from 5 to 40 μm, and particularly preferably from 10 to 30 μm.

In the present invention, a surface protective layer may further be provided on the photosensitive layer so that the photosensitive layer can be protected from mechanical, chemical or electrical adverse influences externally exerted. The protective layer contains at least the copolymer of the present invention, which may be used in a mixture thereof with a different type of resin. Such a different type of resin may be the same as those previously described. The protective layer may be solely comprised of the resin, or may also contain the charge-transporting material previously described or a conductive material such as a conductive powder. The conductive powder may include powders of metals such as aluminum, copper, nickel and copper, scaly metal powders, metal short fibers, conductive metal oxides such as antimony oxide, indium oxide and tin oxide, polymeric conductive agents such as polypyrrole, polyaniline and polymeric electrolytes, and conductive powders such as carbon black, carbon fiber and graphite powder, and organic or inorganic electrolytes or the conductive powder of particles whose surfaces are coated with such conductive materials.

In the present invention, the protective layer is defined to be also included in the photosensitive layer.

The thickness of the protective layer is selected taking account of electrophotographic performances and durability. The protective layer may preferably have a layer thickness of from 0.2 μm to 15 μm, and particularly preferably from 0.5 μm to 15 μm.

In the present invention, a subbing layer endowed with a barrier function and an adhesive function may be provided between the conductive support and the photosensitive layer.

Materials for the subbing layer may include casein, polyvinyl alcohol, nitro cellulose, an ethylene-acrylic acid copolymer, polyvinyl butyral, phenol resin polyamides such as nylon 6, nylon 66, nylon 610, copolymer nylon and alkoxymethylated nylon, polyurethane, gelatin, and aluminum oxide. The subbing layer may preferably have a layer thickness of from 0.1 to 10 μm, and particularly preferably from 0.1 to 5 μm.

In the present invention, between the support and the photosensitive layer or the support and the subbing layer, a coating may be formed for the purpose of compensating any surface faults, or a conductive layer may be provided for the purpose of preventing interference bands which occur especially when the image input is carried out using laser light. This conductive layer can be formed by coating a solution prepared by dispersing metal particles or conductive metal oxide powder in a suitable binder resin, followed by drying. The conductive layer may preferably have a layer thickness of from 5 to 40 μm, and particularly from 10 to 30 μm.

All the layers describe above can be formed by coating methods such as dip coating, spray coating, spin coating, bead coating, blade coating and beam coating.

The conductive support used in the present invention may be comprised of a support which is electrically-conductive in itself, as exemplified by aluminum, aluminum alloy, copper, zinc, stainless steel, vanadium, molybdenum, chromium, titanium, nickel, indium, gold or platinum. Besides these, it may also include a plastic or paper having a conductive layer formed by vacuum deposition of aluminum, aluminum alloy, indium oxide, tin oxide or indium oxide-tin oxide alloy, a support comprising a plastic or paper impregnated with conductive particles, and a plastic having a conductive polymer.

The support may have the form of a drum, a sheet or a belt, and may have any form according to electrophotographic apparatus used.

The photosensitive member of the present invention can be commonly used in electrophotographic apparatus such as copying machines, laser printers, LED printers and liquid crystal shutter type printers. It may also be widely used in display, recording, light printing, lithographic and facsimile apparatus which electrophotography is applied to.

Figure 3:
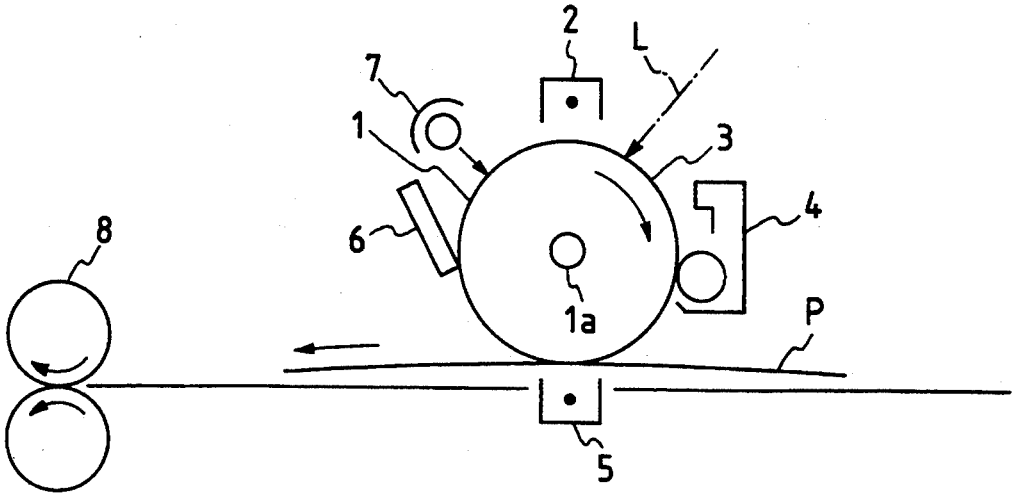
FIG. 3 schematically illustrates an electrophotographic apparatus having the electrophotographic photosensitive member of the present invention.

FIG. 3 schematically illustrates an example of the structure of an electrophotographic apparatus in which the photosensitive member of the present invention is used.

In FIG. 3, reference numeral 1 denotes a drum photosensitive member serving as an image bearing member, which is rotated around a shaft la at a given peripheral speed in the direction shown by an arrow. In the course of rotation, the photosensitive member 1 is uniformly charged on its periphery, with positive or negative given potential by the operation of a charging means 2, and then photoimagewise exposed to light L (slit exposure, laser beam scanning exposure, etc.) at an exposure zone 3 by the operation of an imagewise exposure means (not shown). As a result, electrostatic latent images corresponding to the exposure images are successively formed on the periphery of the photosensitive member.

The electrostatic latent images thus formed are subsequently developed by toner by the operation of a developing means 4. The resulting toner-developed images are then successively transferred by the operation of a transfer means 5, to the surface of a transfer medium P fed from a paper feed section (not shown) into the part between the photosensitive member 1 and the transfer means 5 in the manner synchronized with the rotation of the photosensitive member 1.

The transfer medium P on which the images have been transferred is separated from the surface of the photosensitive member and led through an image-fixing means 8, where the images are fixed and then delivered to the outside as a transcript (a copy).

The surface of the photosensitive member 1 after the transfer of images is brought to removal of the toner remaining after the transfer, using a cleaning means 6. Thus the photosensitive member is cleaned on its surface, further subjected to charge elimination by a pre-exposure means 7, and then repeatedly used for the formation of images.

The charging means 2 for imparting uniform charge on the photosensitive member 1 includes corona assemblies, which are commonly put into wide use. As the transfer means 5, corona transfer assemblies are also commonly put into wide use.

The electrophotographic apparatus may be constituted of a combination of plural components joined as one device unit from among the constituents such as the above photosensitive member, developing means and cleaning means so that the unit can be freely mounted on or detached from the body of the apparatus. For example, the photosensitive member 1 and at least one of the charging means, developing means and cleaning means may be joined into one device unit so that the unit can be freely mounted or detached using a guide means such as a rail provided in the body of the apparatus. Here, the above device unit may be so constructed as to be joined together with the charging means and/or the developing means.

In the case when the electrophotographic apparatus is used as a copying machine or a printer, the photosensitive member is exposed to optical image exposing light L by irradiation with light reflected from, or transmitted through, an original, or by the scanning of a laser beam, the driving of an LED array or the driving of a liquid crystal shutter array according to signals obtained by reading an original with a sensor and converting the information into signals.

Figure 4:
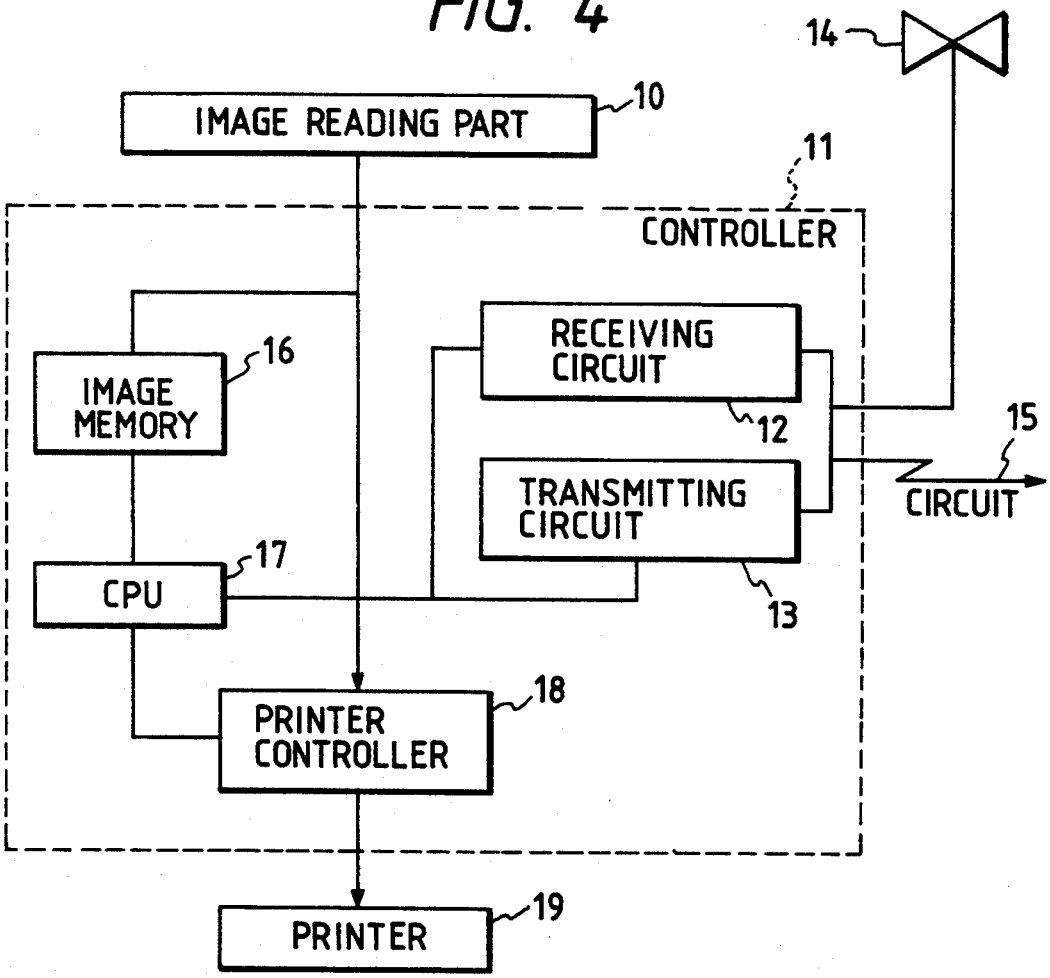
FIG. 4 is a block diagram of a facsimile machine having the electrophotographic photosensitive member of the present invention.

When used as a printer of a facsimile machine, the optical image exposing light L serves as exposing light used for the printing of received data. FIG. 4 illustrates an example thereof in the form of a block diagram.

As shown in FIG. 4, a controller 11 controls an image reading part 10 and a printer 19. The whole of the controller 11 is controlled by CPU 17. Image data outputted from the image reading part is sent to the other facsimile station through a transmitting circuit 13. Data received from the other station is sent to a printer 19 through a receiving circuit 12. Given image data are stored in an image memory 16. A printer controller 18 controls the printer 19. The numeral 14 denotes a telephone.

An image received from a circuit 15 (image information from a remote terminal connected through the circuit) is demodulated in the receiving circuit 12, and then successively stored in an image memory 16 after the image information is decoded by the CPU 17. Then, when images for at least one page have been stored in the memory 16, the image recording for that page is carried out. The CPU 17 reads out the image information for one page from the memory 16 and sends the decoded image information for one page to the printer controller 18. The printer controller 18, having received the image information for one page from the CPU 17, controls the printer 19 so that the image information for one page is recorded.

The CPU 17 receives image information for next page in the course of the recording by the printer 19.

Images are received and recorded in this way.

The present invention will be described below in greater detail by giving Examples.

The TEM observation in the present invention was made in the following way: Coatings were cut into pieces with a thickness of about 0.1 μm using a microtome (Ultracut-N, Reihelt Nissei Co.), which were steam-dyed using ruthenium tetraoxide to produce samples. The observation was made under the following conditions.

(1) TEM: JEM2000EXa, manufactured by Nippon Denshi (2) Accelerating voltage: 200 kV (3) Magnification: 10,000x In the following, "part(s)" refers to "part(s) by weight".

EXAMPLE 1

In a sand mill making use of glass beads of 1 mm in diameter, 50 parts of conductive titanium oxide powder whose particle surfaces were coated with tin oxide containing 10% of antimony oxide, 25 parts of phenol resin, 20 parts of methyl cellosolve, 5 parts of methanol and 0.002 part of silicone oil (a polydimethylsiloxane-polyoxyalkylene copolymer; average molecular weight: 3,000) were dispersed for 2 hours to give a conductive layer coating composition. This coating composition was applied onto an aluminum sheet by Mayar bar coating, followed by drying at 140° C. for 30 minutes to form a conductive layer with a layer thickness of 20 μm.

Next, 5 parts of N-methoxymethylated nylon was dissolved in 95 parts of methanol to give an intermediate layer coating composition. This coating composition was applied onto the above conductive layer by Meyer bar coating, followed by drying at 100° C. for 20 minutes to form a subbing layer of 0.6 μm thick.

Subsequently, in a sand mill making use of glass beads of 1 mm in diameter, 3 parts of disazo pigment as a charge-generating material, represented by the formula:

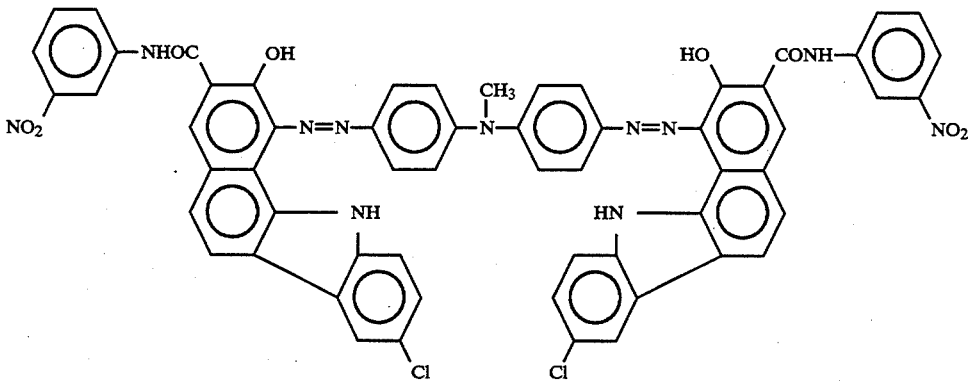

2 parts of polyvinyl benzal (benzalation ratio: 80%; weight average molecular weight: 11,000) and 35 parts of cyclohexane were dispersed for 12 hours, followed by addition of 60 parts of methyl ethyl ketone to give a dispersion for charge generation layer. This dispersion was coated on the above intermediate layer by Meyer bar coating, followed by drying to form a charge generation layer with a layer thickness of 0.2 μm.

Next, 10 parts of hydrazone compound as a charge-transporting material, represented by the formula:

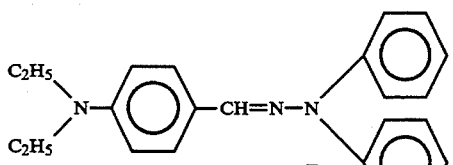

and 10 parts of random copolymer represented by the formula:

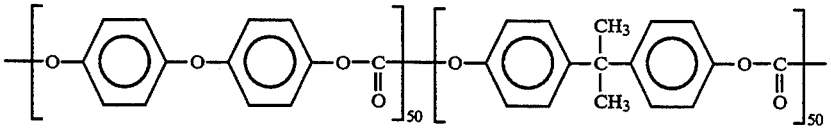

(viscosity average molecular weight: $2.16\times10^4$; having a uniform structure as confirmed by TEM observation of its coating; the numerals indicates copolymerization ratio in molar ratio and the same applies hereinafter) were dissolved in a mixed solvent comprised of 20 parts of dichloromethane and 40 parts of monochlorobenzene. The resulting solution was coated on the above charge generation layer by Meyer bar coating, followed by drying at 120° C. for 60 minutes to form a charge transport layer with a layer thickness of 18 μm.

On the photosensitive member thus produced, its wear resistance and electrophotographic performance were evaluated. The wear resistance was tested using an abrasion tester No.101 T-bar type, manufactured by Yasuda Seiki Co. As an abrasive material, commercially available copy paper was used. The electrophotographic performance was evaluated by measuring light-discharge characteristics using a conductive glass sheet of 10 $cm^2$.

Results obtained are shown in Table 1.

EXAMPLE 2

A photosensitive member was produced and evaluated in the same manner as in Example 1 except that the charge transport layer was formed using a random copolymer represented by the formula:

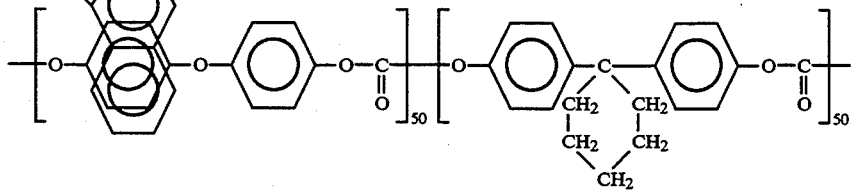

(viscosity average molecular weight: $2.51\times10^4$; having a uniform structure as confirmed by TEM observation of its coating).

Results obtained are shown in Table 1.

EXAMPLE 3

A photosensitive member was produced and evaluated in the same manner as in Example 1 except that the charge transport layer was formed using a random copolymer represented by the formula:

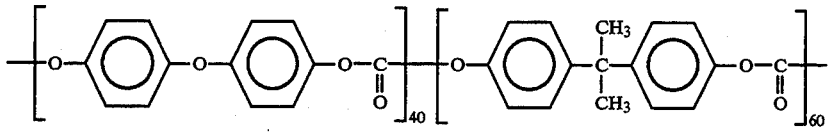

(viscosity average molecular weight: $9.56\times10^4$; having a uniform structure as confirmed by TEM observation of its coating).

Results obtained are shown in Table 1.

EXAMPLE 4

A photosensitive member was produced and evaluated in the same manner as in Example 1 except that the charge transport layer was formed using a random copolymer represented by the formula:

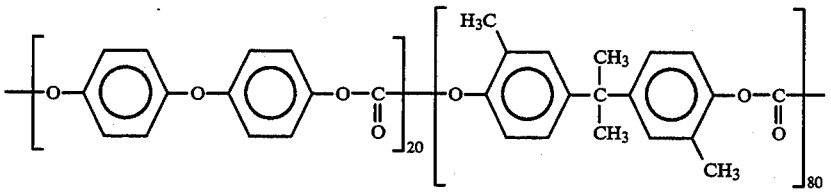

(viscosity average molecular weight: $3.28\times10^4$; having a uniform structure as confirmed by TEM observation of its coating).

Results obtained are shown in Table 1.

EXAMPLE 5

A photosensitive member was produced and evaluated in the same manner as in Example 1 except that the charge transport layer was formed using a random copolymer represented by the formula:

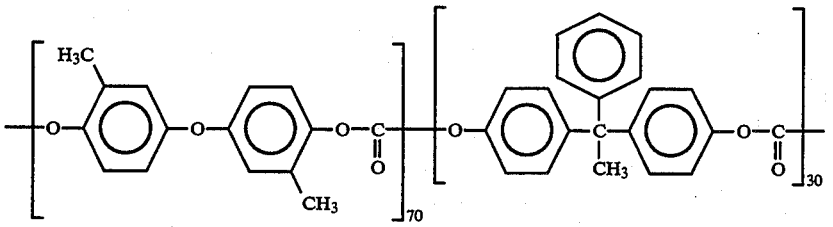

(viscosity average molecular weight: $2.35\times10^4$; having a uniform structure as confirmed by TEM observation of its coating).

Results obtained are shown in Table 1.

COMPARATIVE EXAMPLE 1

A photosensitive member was produced and evaluated in the same manner as in Example 1 except that the charge transport layer was formed using polycarbonate-A (viscosity average molecular weight: $3.2\times10^4$).

Results obtained are shown in Table 1.

COMPARATIVE EXAMPLE 2

A photosensitive member was produced and evaluated in the same manner as in Example 1 except that the charge transport layer was formed using polycarbonate-Z (viscosity average molecular weight: $3.6\times10^4$).

Results obtained are shown in Table 1.

COMPARATIVE EXAMPLE 3

A photosensitive member was produced and evaluated in the same manner as in Example 1 except that the charge transport layer was formed using a copolymer represented by the formula:

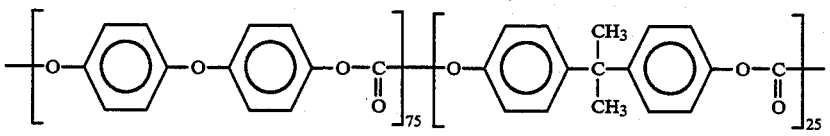

(viscosity average molecular weight: $2.57\times10^4$; having a fine non-uniform structure as confirmed by TEM observation of its coating).

Results obtained are shown in Table 1.

COMPARATIVE EXAMPLE 4

A photosensitive member was produced and evaluated in the same manner as in Example 1 except that the charge transport layer was formed using a copolymer represented by the formula:

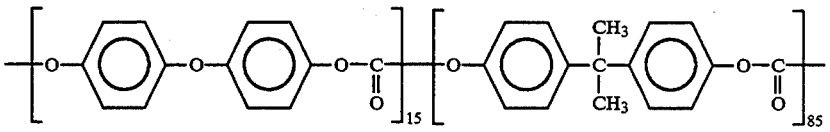

(viscosity average molecular weight: $2.05\times10^4$; having a fine non-uniform structure as confirmed by TEM observation of its coating).

Results obtained are shown in Table 1.

COMPARATIVE EXAMPLE 5

A photosensitive member was produced and evaluated in the same manner as in Example 1 except that the charge transport layer was formed using a copolymer represented by the formula:

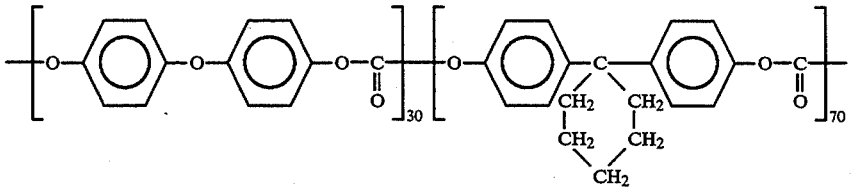

(viscosity average molecular weight: $2.8\times10^4$; having a fine non-uniform structure as confirmed by TEM observation of its coating).

Results obtained are shown in Table 1.

TABLE 1

| | Electrophotographic performance | | | | Liquid* |
|---|---|---|---|---|---|
| | Sensitivity $\mu J/cm^2$ (778 nm) | Residual potential (V) | Abrasion wear (mg/ 1,000 rap) | Black spots | storage stability |
| Example: | | | | | |
| 1 | 0.68 | 31 | 0.62 | AA | AA |
| 2 | 0.75 | 28 | 0.71 | AA | AA |
| 3 | 0.61 | 25 | 0.65 | AA | AA |
| 4 | 0.65 | 33 | 0.73 | AA | AA |

TABLE 1-continued

| | Electrophotographic performance | | | | Liquid* |
|---|---|---|---|---|---|
| | Sensitivity $\mu J/cm^2$ (778 nm) | Residual potential (V) | Abrasion wear (mg/ 1,000 rap) | Black spots | storage stability |
| 5 | 0.70 | 29 | 0.52 | AA | AA |
| Comparative Example: | | | | | |
| 1 | 1.32 | 45 | 4.9 | C | C |
| 2 | 1.20 | 43 | 4.5 | C | A |
| 3 | 0.92 | 38 | 1.2 | C | C |
| 4 | 0.80 | 34 | 0.87 | C | C |
| 5 | 0.78 | 37 | 0.98 | C | C |

*(monochlorobenzene; 90 days)
Remarks:
AA: Excellent, A: Good, C: Failure

EXAMPLE 6

A photosensitive member was produced and evaluated in the same manner as in Example 1 except that the charge generation layer was formed using a disazo pigment represented by the formula:

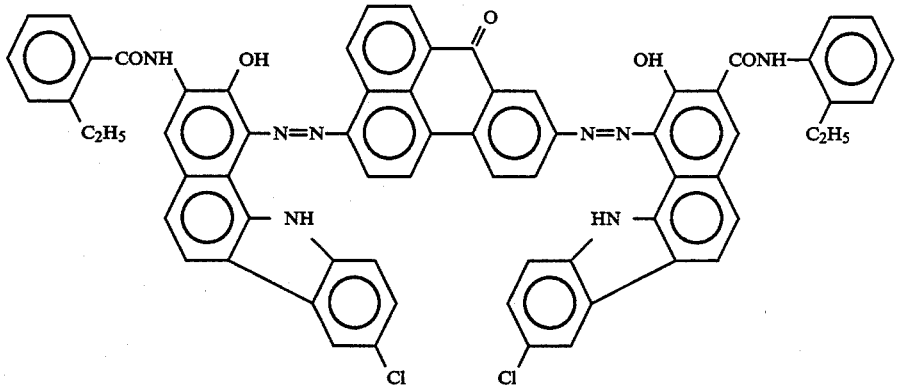

and the charge transport layer was formed using a random copolymer represented by the formula:

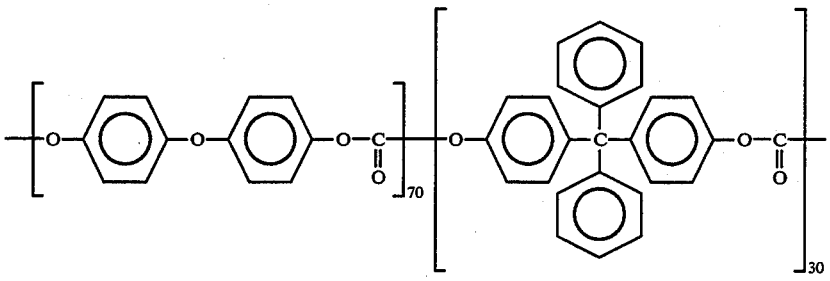

(viscosity average molecular weight: $2.23\times10^4$; having a uniform structure as confirmed by TEM observation of its coating) and as a charge-transporting material a compound represented by the formula:

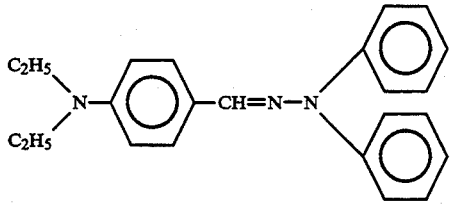

Results obtained are shown in Table 2.

EXAMPLE 7

A photosensitive member was produced and evaluated in the same manner as in Example 6 except that the charge transport layer was formed using a random copolymer represented by the formula:

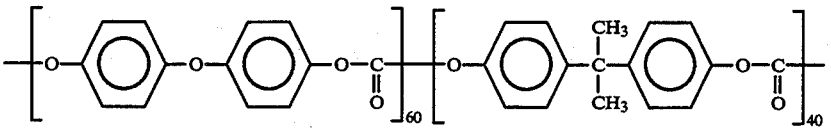

(viscosity average molecular weight: $2.98\times10^4$; having a uniform structure as confirmed by TEM observation of its coating). Evaluation was also made similarly.

Results obtained are shown in Table 2.

EXAMPLE 8

A photosensitive member was produced and evaluated in the same manner as in Example 6 except that the charge transport layer was formed using a random copolymer represented by the formula:

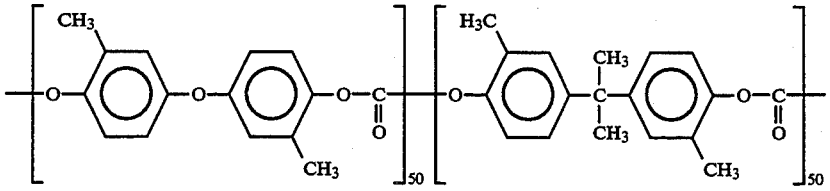

(viscosity average molecular weight: $2.34\times10^4$; having a uniform structure as confirmed by TEM observation of its coating).

Results obtained are shown in Table 2.

EXAMPLE 9

A photosensitive member was produced and evaluated in the same manner as in Example 6 except that the charge transport layer was formed using a random copolymer represented by the formula:

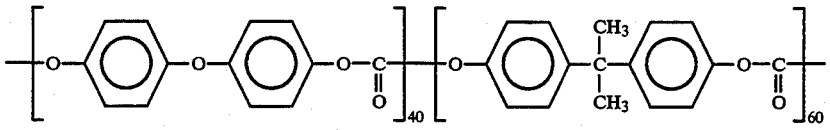

(viscosity average molecular weight: $4.10\times10^4$; having a uniform structure as confirmed by TEM observation of its coating).

Results obtained are shown in Table 2.

EXAMPLE 10

A photosensitive member was produced and evaluated in the same manner as in Example 6 except that the charge transport layer was formed using a random copolymer represented by the formula:

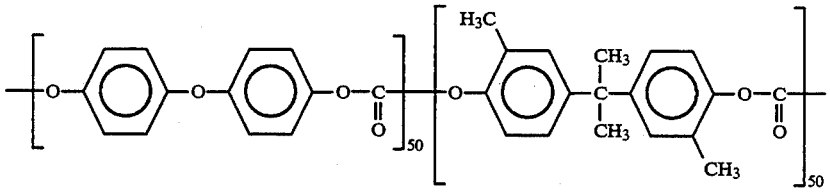

(viscosity average molecular weight: $2.86\times10^4$; having a uniform structure as confirmed by TEM observation of its coating).

Results obtained are shown in Table 2.

COMPARATIVE EXAMPLE 6

A photosensitive member was produced and evaluated in the same manner as in Example 6 except that the charge transport layer was formed using polycarbonate-A (viscosity average molecular weight: $3.2\times10^4$).

Results obtained are shown in Table 2.

COMPARATIVE EXAMPLE 7

A photosensitive member was produced and evaluated in the same manner as in Example 6 except that the charge transport layer was formed using polycarbonate-Z (viscosity average molecular weight: $3.6\times10^4$).

Results obtained are shown in Table 2.

COMPARATIVE EXAMPLE 8

A photosensitive member was produced and evaluated in the same manner as in Example 6 except that the charge transport layer was formed using a copolymer represented by the formula:

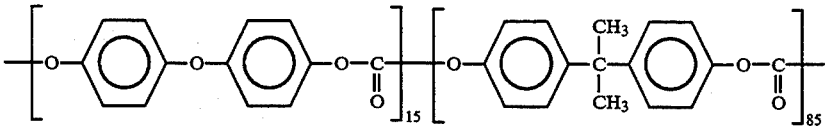

(viscosity average molecular weight: $2.05\times10^4$; having a fine non-uniform structure as confirmed by TEM observation of its coating).

Results obtained are shown in Table 2.

TABLE 2

| | Electrophotographic performance | | | | Liquid* |
|---|---|---|---|---|---|
| | Sensitivity $\mu J/cm^2$ (778 nm) | Residual potential (V) | Abrasion wear (mg/1,000 rap) | Black spots | storage stability |
| Example: | | | | | |
| 6 | 0.48 | 22 | 0.50 | AA | AA |
| 7 | 0.45 | 28 | 0.61 | AA | AA |
| 8 | 0.51 | 25 | 0.58 | AA | AA |
| 9 | 0.55 | 30 | 0.63 | AA | AA |
| 10 | 0.51 | 29 | 0.52 | AA | AA |
| Comparative Example: | | | | | |
| 6 | 1.10 | 41 | 4.3 | C | C |

TABLE 2-continued

| | Electrophotographic performance | | | | Liquid* |
|---|---|---|---|---|---|
| | Sensitivity $\mu J/cm^2$ (778 nm) | Residual potential (V) | Abrasion wear (mg/1,000 rap) | Black spots | storage stability |
| 7 | 0.87 | 35 | 4.4 | C | A |
| 8 | 0.70 | 37 | 0.67 | C | C |

*(monochlorobenzene; 90 days)
Remarks:
AA: Excellent, A: Good, C: Failure

EXAMPLE 11

A conductive layer, a subbing layer and a charge generation layer were formed in the same manner as in Example 1 except that the support was replaced with an aluminum cylinder and the coating was carried out by dip coating, and provided the charge-generating material as used in Example 6 was used.

Next, 10 parts of butadiene compound represented by the formula:

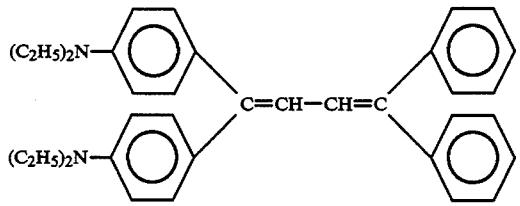

and 10 parts of random copolymer represented by the formula:

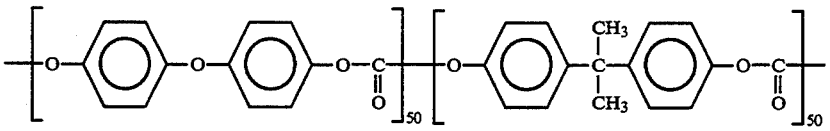

(viscosity average molecular weight: $2.05\times10^4$; having a uniform structure as confirmed by TEM observation of its coating) were dissolved in a mixed solvent comprised of 20 parts of dichloromethane and 40 parts of monochlorobenzene. The resulting solution was coated on the above charge generation layer by dip coating, followed by drying at 120° C. for 60 minutes to form a charge transport layer with a layer thickness of 18 $\mu$m.

Then, using the resulting photosensitive member in a commercially available laser printer, electrophotographic performance was evaluated. As a result, no black spots were seen and also good images were obtained substantially without scratches, even after running on 10,000 sheets.

EXAMPLE 12

A photosensitive member was produced and evaluated in the same manner as in Example 11 except that the charge transport layer was formed using a random copolymer represented by the formula:

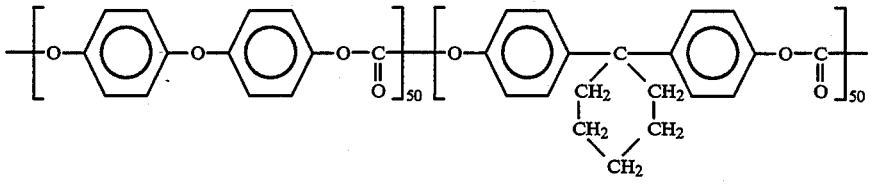

(viscosity average molecular weight: $2.51\times10^4$; having a uniform structure as confirmed by TEM observation of its coating).

Results obtained are shown in Table 3.

EXAMPLE 13

A photosensitive member was produced and evaluated in the same manner as in Example 11 except that the charge transport layer was formed using a random copolymer represented by the formula:

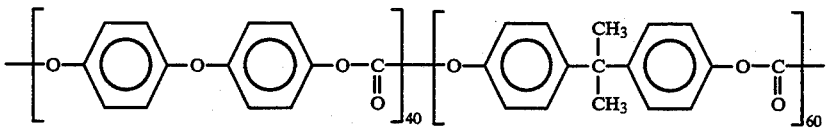

(viscosity average molecular weight: $9.56\times10^4$; having a uniform structure as confirmed by TEM observation of its coating).

Results obtained are shown in Table 3.

EXAMPLE 14

A photosensitive member was produced and evaluated in the same manner as in Example 11 except that the charge transport layer was formed using a random copolymer represented by the formula:

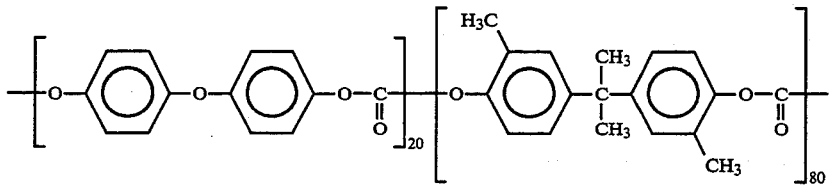

(viscosity average molecular weight: $3.28\times10^4$; having a uniform structure as confirmed by TEM observation of its coating).

Results obtained are shown in Table 3.

EXAMPLE 15

A photosensitive member was produced and evaluated in the same manner as in Example 11 except that the charge transport layer was formed using a random copolymer represented by the formula:

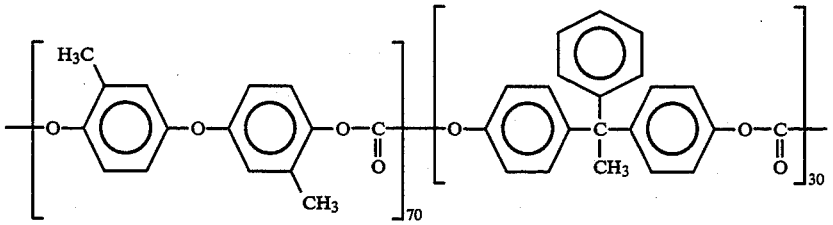

(viscosity average molecular weight: $2.35\times10^4$; having a uniform structure as confirmed by TEM observation of its coating).

Results obtained are shown in Table 3.

COMPARATIVE EXAMPLE 9

A photosensitive member was produced and evaluated in the same manner as in Example 11 except that the charge transport layer was formed using polycarbonate-A (viscosity average molecular weight: $3.2\times10^4$).

Results obtained are shown in Table 3.

COMPARATIVE EXAMPLE 10

A photosensitive member was produced and evaluated in the same manner as in Example 11 except that the charge transport layer was formed using polycarbonate-Z (viscosity average molecular weight: $3.6\times10^4$).

Results obtained are shown in Table 3.

COMPARATIVE EXAMPLE 11

A photosensitive member was produced and evaluated in the same manner as in Example 11 except that the charge transport layer was formed using a copolymer represented by the formula:

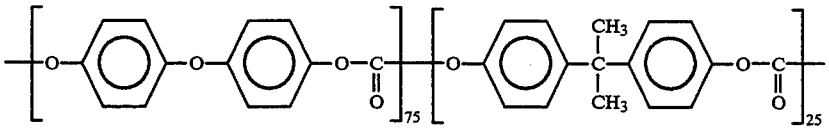

(viscosity average molecular weight: $2.57\times10^4$; having a fine non-uniform structure as confirmed by TEM observation of its coating).

Results obtained are shown in Table 3.

Then, using the photosensitive member obtained in Comparative Examples 9–11 in a commercially available laser printer, electrophotographic performance was evaluated. As a result, black spots were seen even at the initial stage. After running on 10,000 sheets, deep scratches occurred on the surface layer to cause faulty images.

TABLE 3

| | Electrophotographic performance | | | |
|---|---|---|---|---|
| | Sensitivity $\mu J/cm^2$ (778 nm) | Residual potential (V) | Black spots | Liquid* storage stability |
| Example: | | | | |
| 11 | 0.28 | 21 | AA | AA |
| 12 | 0.25 | 23 | AA | AA |
| 13 | 0.21 | 22 | AA | AA |
| 14 | 0.25 | 25 | AA | AA |
| 15 | 0.31 | 32 | AA | AA |
| Comparative Example: | | | | |
| 9 | 0.95 | 54 | C | C |
| 10 | 0.92 | 43 | C | A |
| 11 | 0.50 | 35 | C | C |

*(monochlorobenzene; 90 days)
Remarks:
AA: Excellent, A: Good, C: Failure

What is claimed is:

1. An electrophotographic photosensitive member comprising a conductive support and a photosensitive layer provided thereon, wherein said photosensitive layer contains a random copolymer having a structural unit represented by the following Formula (I):

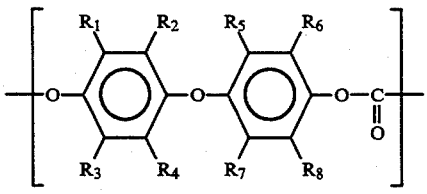

(I)

wherein $R_1$ to $R_8$ each represent a hydrogen atom, a halogen atom, a hydroxyl group or an alkyl group having 1 to 4 carbon atoms; and a structural unit represented by the following Formula (II):

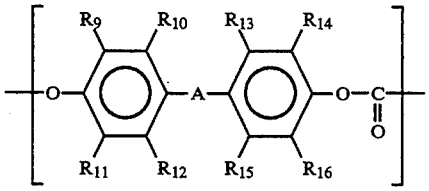

(II)

wherein A represents a straight-chain, branched or cyclic alkylidene group having 1 to 10 carbon atoms, an aryl-substituted alkylidene group or an arylene group; and $R_9$ to $R_{16}$ each represent a hydrogen atom, a halogen atom, a hydroxyl group or an alkyl group having 1 to 4 carbon atoms.

2. An electrophotographic photosensitive member according to claim 1, wherein said structural unit represented by Formula (I) is a unit represented by the formula:

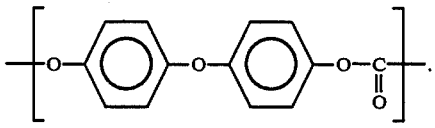

3. An electrophotographic photosensitive member according to claim 1, wherein said structural unit represented by Formula (II) is a unit represented by the formula:

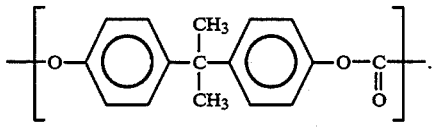

4. An electrophotographic photosensitive member according to claim 1, wherein said structural unit represented by Formula (II) is a unit represented by the formula:

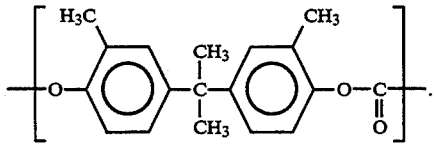

5. An electrophotographic photosensitive member according to claim 1, wherein said structural unit represented by Formula (II) is a unit represented by the formula:

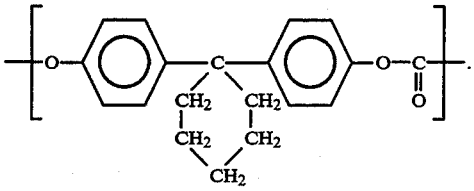

6. An electrophotographic photosensitive member according to claim 1, wherein said structural unit represented by Formula (II) is a unit represented by the formula:

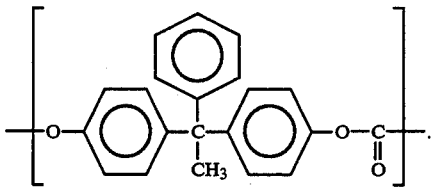

7. An electrophotographic photosensitive member according to claim 1, wherein said structural unit represented by Formula (II) is a unit represented by the formula:

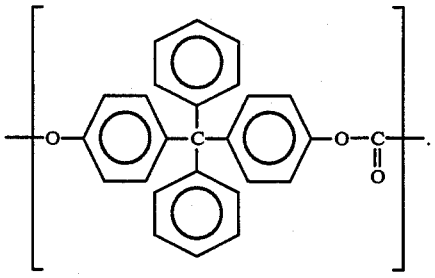

8. An electrophotographic photosensitive member according to claim 1, wherein said structural unit represented by Formula (I) and said structural unit represented by Formula (II) are in a molar ratio of from 5:95 to 95:5.

9. An electrophotographic photosensitive member according to claim 1, wherein said structural unit represented by Formula (I) and said structural unit represented by Formula (II) are in a molar ratio of from 20:80 to 70:30.

10. An electrophotographic photosensitive member according to claim 1, wherein said structural unit represented by Formula (I) and said structural unit represented by Formula (II) are in a molar ratio of from 35:65 to 65:35.

11. An electrophotographic photosensitive member according to claim 1, wherein said photosensitive layer has a charge generation layer and a charge transport layer.

12. An electrophotographic photosensitive member according to claim 11, wherein said charge transport layer is provided on said charge generation layer, and said charge generation layer is provided on said conductive support.

13. An electrophotographic photosensitive member according to claim 12, wherein said charge transport layer contains the random copolymer having the structural unit represented by Formula (I) and the structural unit represented by Formula (II).

14. An electrophotographic photosensitive member according to claim 11, wherein said charge generation layer is provided on said charge transport layer, and said charge transport layer is provided on said conductive support.

15. An electrophotographic photosensitive member according to claim 14, wherein said charge generation layer contains the random copolymer having the structural unit represented by Formula (I) and the structural unit represented by Formula (II).

16. An electrophotographic photosensitive member according to claim 1, wherein said photosensitive layer is formed of a single layer.

17. An electrophotographic photosensitive member according to claim 11, wherein said photosensitive layer has a protective layer.

18. An electrophotographic photosensitive member according to claim 1, wherein a subbing layer is provided between said conductive support and said photosensitive layer.

19. An electrophotographic apparatus comprising an electrophotographic photosensitive member, an electrostatic latent image forming means, a means for developing the electrostatic latent image formed, and a means for transferring the developed image to a transfer medium;

said electrophotographic photosensitive member comprising a conductive support and a photosensitive layer provided thereon; said photosensitive layer containing a random copolymer having a structural unit represented by the following Formula (I):

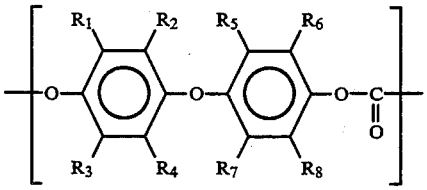

(I)

wherein $R_1$ to $R_8$ each represent a hydrogen atom, a halogen atom, a hydroxyl group or an alkyl group having 1 to 4 carbon atoms; and a structural unit represented by the following Formula (II):

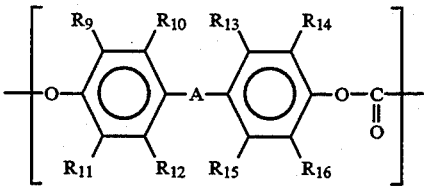

(II)

wherein A represents a straight-chain, branched or cyclic alkylidene group having 1 to 10 carbon atoms, an aryl-substituted alkylidene group or an arylene group; and $R_9$ to $R_{16}$ each represent a hydrogen atom, a halogen atom, a hydroxyl group or an alkyl group having 1 to 4 carbon atoms.

20. A device unit comprising an electrophotographic photosensitive member, and at least one means selected from a charging means, a developing means, and a cleaning means;

said electrophotographic photosensitive member comprising a conductive support and a photosensitive layer provided thereon; said photosensitive layer containing a random copolymer having a structural unit represented by the following formula (I):

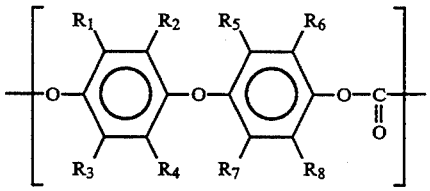

(I)

wherein $R_1$ to $R_8$ each represent a hydrogen atom, a halogen atom, a hydroxyl group or an alkyl group having 1 to 4 carbon atoms;

and a structural unit represented by the following Formula (II):

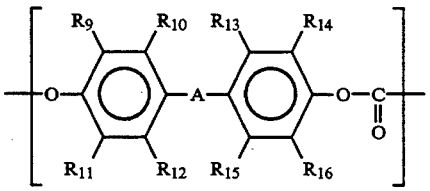

(II)

wherein A represents a straight-chain, branched or cyclic alkylidene group having 1 to 10 carbon atoms, an aryl-substituted alkylidene group or an arylene group; and $R_9$ to $R_{16}$ each represent a hydrogen atom, a halogen atom, a hydroxyl group or an alkyl group having 1 to 4 carbon atoms; and said device unit holding said electrophotographic photosensitive member, and said at least one means as one unit, and said device unit being detachably provided in the body of an electrophotographic apparatus.

21. A facsimile machine comprising an electrophotographic apparatus and a receiver means for receiving image information from a remote terminal;

said electrophotographic apparatus comprising an electrophotographic photosensitive member; and said electrophotographic photosensitive member comprising a conductive support and a photosensitive layer provided thereon; said photosensitive layer containing a random copolymer having a structural unit represented by the following Formula (I):

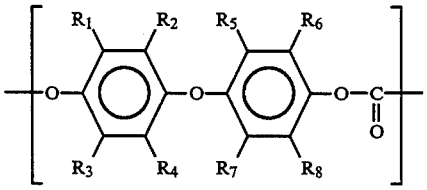

(I)

wherein $R_1$ to $R_8$ each represent a hydrogen atom, a halogen atom, a hydroxyl group or an alkyl group having 1 to 4 carbon atoms; and a structural unit represented by the following Formula (II):

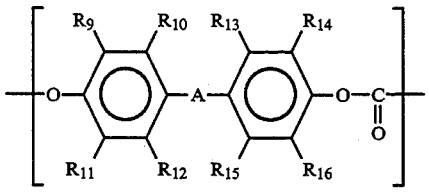

(II)

wherein A represents a straight-chain, branched or cyclic alkylidene group having 1 to 10 carbon atoms, an aryl-substituted alkylidene group or an arylene group; and $R_9$ to $R_{16}$ each represent a hydrogen atom, a halogen atom, a hydroxyl group or an alkyl group having 1 to 4 carbon atoms.

* * * * *

UNITED STATES PATENT AND TRADEMARK OFFICE

CERTIFICATE OF CORRECTION

PATENT NO. : 5,418,098

DATED : May 23, 1995

INVENTOR : SHINYA MAYAMA, ET AL

It is certified that errors appear in the above-identified patent and that said Letters Patent is hereby corrected as shown below:

Title Page:

[56] References Cited

Foreign Patent Documents, "2240655 9/1990 Japan
403273255 12/1991 Japan"
should read --2-240655 9/1990 Japan
3-273255 12/1991 Japan--.

COLUMN 1

Line 11, "particularly" should read --particularly,--.

COLUMN 7

Line 42, "compolymar," should read --copolymer--.

COLUMN 9

Line 13, "azulanium" should read --azulenium--; and

Line 23, "preferably" should read --preferably be--.

COLUMN 10

Line 53, "describe" should read --described--.

COLUMN 13

" 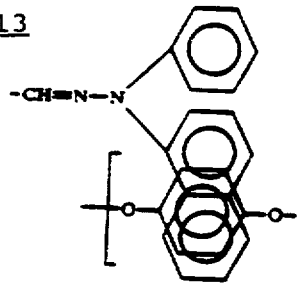 " should read -- 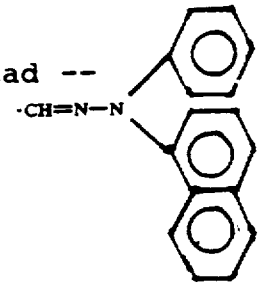 --

UNITED STATES PATENT AND TRADEMARK OFFICE

CERTIFICATE OF CORRECTION

PATENT NO. : 5,418,098

DATED : May 23, 1995

INVENTOR : SHINYA MAYAMA, ET AL

It is certified that errors appear in the above-identified patent and that said Letters Patent is hereby corrected as shown below:

COLUMN 14

Line 12, "indicates" should read --indicate--; and

Line 55, " 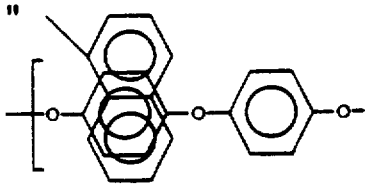 " should read -- 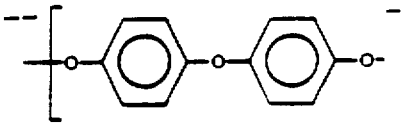 --

Signed and Sealed this

Seventeenth Day of October, 1995

*Attest:*

*Attesting Officer*

BRUCE LEHMAN

*Commissioner of Patents and Trademarks*